United States Patent [19]

Kawamura

[11] Patent Number: 4,967,974

[45] Date of Patent: Nov. 6, 1990

[54] TAPING EQUIPMENT FOR WEB FEEDING DEVICE

[75] Inventor: Masanori Kawamura, Kasugai, Japan

[73] Assignee: Isowa-Hooper Swift, Ltd., Nishiya, Japan

[21] Appl. No.: 352,321

[22] Filed: May 16, 1989

[30] Foreign Application Priority Data

May 27, 1988 [JP] Japan ..... 63-131159

[51] Int. Cl.[5] ..... B56H 16/06; B64C 5/03

[52] U.S. Cl. ..... 242/55; 242/58.1; 156/446

[58] Field of Search ..... 242/58.1–58.5, 242/56 R, 56 A, 55; 156/187, 191, 446, 447

[56] References Cited

U.S. PATENT DOCUMENTS

| | | | |
|---|---|---|---|
| 3,869845 | 3/1975 | Rodach et al. | 156/447 X |
| 3,901,757 | 8/1975 | Eglinton | 156/446 |
| 4,094,727 | 6/1978 | Collins | 242/58.1 X |
| 4,299,642 | 11/1981 | Berkholtz | 242/56 R X |
| 4,422,588 | 12/1983 | Nowisch | 252/56 R X |
| 4,581,083 | 4/1986 | Schutz et al. | 156/191 X |
| 4,599,130 | 7/1986 | Woodley | 242/58.1 X |

*Primary Examiner*—John M. Jillions

*Attorney, Agent, or Firm*—Schwartz & Weinrieb

[57] ABSTRACT

Disclosed is taping equipment for a web feeding device wherein feeding of a web from a web roll is achieved by the free rotation of center blocks, and the web is rewound by rotationally driving the center blocks in the direction opposite to the web delivering direction, comprising a lifter; a roller rotatably supported at one end of a first arm pivotally supported upon a support disposed upon the upper surface of the lifter by means of a shaft, and upon which an adhesive tape delivered from a tape roll removably attached to the shaft is conveyed with the adhesive surface thereof facing outwardly; a first actuator connected to the other end of the first arm which rotates the first arm around the shaft so as to bring it to a position at which the roller is abutted against the circumferential surface of the web roll or to the position at which the roller is spaced from the web roll; a cutter disposed at the tip of a second arm; a second actuator connected to the second arm which rotates the second arm around the shaft so as to bring it to a tape cutting position or to a stand-by-position; and a braking means disposed relative to the first arm which exerts a braking force upon the tape so as to prevent further delivery of the tape when the tape is to be cut.

11 Claims, 7 Drawing Sheets

(a)

(b)

(c)

TAPING EQUIPMENT FOR WEB FEEDING DEVICE

FIELD OF THE INVENTION

This invention relates generally to taping equipment, and more particularly to taping equipment for use within a web feeding device rotatably supporting thereon a web roll which feeds out a web to a predetermined web consuming mechanism, wherein the cut end portion of the web conventionally hanging from a used web roll, after the performance of a cutting operation within the head of a splicer upon completion of a splicing operation between a downstream portion of the used web which has already been conveyed to the aforenoted predetermined web consuming mechanism from the used web roll and the leading end portion of a new web being unwound from a new web roll, is automatically rewound and bonded to the body of the used web roll by means of an adhesive tape.

BACKGROUND OF THE INVENTION

Rolls comprising a single web such as for example, long paper, a film, or a metal foil, or a composite sheet such as, for example, a laminated film having been wound upon a hollow core are widely used in various fields of industrial applications. For example, in an offset rotary press or a typographical rotary press, a web feeding device having loaded thereon a printing paper web (hereinafter referred to as "web") which is wound into the form of a roll (hereinafter referred to as "web roll") so as to deliver the web therefrom to a web consuming mechanism is indispensable.

As the web feeding device, a mill roll stand of the so-called turret system type in which two arms, supported upon a pivotal shaft so as to extend in substantially opposite directions, are integrally turned, as shown in FIG. 5, is conventionally used. This mill roll stand designated by means of the numeral 10 in the attached drawings has two pairs of arm mechanisms, each comprising an upper arm and a lower arm wherein both are shown with the same reference numeral of 14, which are connected to a pivotal shaft 12 by means of splines, not shown as shown in FIG. 5, wherein only one arm mechanism is illustrated, and wherein further the upper arm 14 and the lower arm 14 are disposed in such a way that they may be extended from the pivotal shaft 12 so as to have a reversed L-shape. This pivotal shaft 12 is driven by means of a motor (not shown) to turn the upper arm 14 and the lower arm 14 integrally together within a predetermined angular range. Incidentally, the pair of arm mechanisms are moved closer together or farther apart relative to each other by driving another motor (not shown) in the positive or negative direction.

At the tip of each arm 14, a conical or pyramidal center block 16 is supported so as to oppose the tip of the corresponding arm 14 of the other arm mechanism, the center block 16 being freely rotatable. This center block 16 is designed to have dimensions such that its tip can be inserted into a paper tube 20 which serves as the core of the web roll 18. Incidentally, a brake means (not shown) actuatable by means of a solenoid or an air pump for preventing overrun of the web which may be caused by the inertia generated by means of the rotation of the web roll 18 is coaxially disposed with respect to each center block 16 so as to exert a suitable amount of braking force with respect to the rotation of the center block 16.

As illustrated, at a position interposed between the upper arm 14 and the lower arm 14, there is disposed a conventional splicer 22 which performs the splicing of the webs.

In the mill roll stand 10 having the aforenoted construction, the web delivered from the web roll 18 loaded within the pair of arms 14 extending upwardly is fed to a rotary press (not shown) disposed downstream of the splicer 22, as shown in FIG. 5, wherein the center blocks 16 rotate freely upon the arms 14 as the web roll 18 rotates and unwinds. When the tension of the web changes as the web is consumed and the diameter of the web roll 18 is reduced, the braking means exerts a suitable amount of braking force with respect to the rotation of the center blocks 16.

Next, when the web roll being fed is replaced by means of another web roll 18 of a different type in accordance with an order change during the operation of the line, a braking force is applied to the center blocks 16 so as to stop the rotation of the web roll 18. Then, as shown in FIG. 6, the splicer 22 performs an automatic splicing operation between the web roll which has been delivering a web (hereinafter referred to as "used web") and the web of a web roll 18 which is disposed in a stand-by posture (hereinafter referred to as "new web") loaded within the lower pair of arms 14, and after cutting of the used web, the splicer 22 performs successive feeding of the new web to the web consuming device of the rotary press.

Immediately after this splicing operation, the splicer 22 is shifted toward the right a predetermined distance so as to avoid interference with the used web roll 18 loaded within the upper pair of arms 14 as the splicer 22 operatively assists in performance of the subsequent web-feeding operation, as shown in FIG. 7. The pivotal shaft 12 is then turned counterclockwise through a predetermined angle so as to dispose the used web roll 18 at a position for transfer onto a web roll transportation means (not shown) such as a flat car, and then the unloaded center blocks 16 mount another web roll therebetween.

On the other hand, a mill roll stand of the so-called swing arm type which is widely known and has a construction which is different from that of the turret system, and other mill roll stands of special construction such as, for example, a drive system or the like are also used. In the chain drive system mill roll stand, a pair of endless routes are provided in parallel with respect to each other and with a predetermined space defined therebetween, and an endless chain is extended along each of the routes such that it can freely travel therealong. A plurality of bases are disposed upon the endless chains with predetermined spaces defined therebetween, and center blocks are disposed upon each base pair such that they may approach each other. More particularly, within the mill roll stand of such a system, a plurality of web rolls are rotatably mounted between a plurality of center blocks disposed within the mill roll stand, and splicing between the used web roll and a new web roll is performed within a known splicer disposed above the mill roll stand.

However, the mill roll stands of the systems mentioned above are all designed such that, when the diameter of the web roll 18 rotatably mounted between the center blocks 16 is reduced after consumption of the web or when a used web roll is to be replaced with another web roll of a different type in accordance with an order change, splicing between the web and old or used the web of a new web roll 18 may be performed within the splicer 22.

In the illustrated mill roll stand 10 of the turret system type, the cut end portion of the used web, after completion of the splicing and cutting operations within the splicer 22, hangs undesirably from the web roll 18, as is clear from FIGS. 6 and 7. More particularly when a web roll 18 loaded within the upper pair of arms 14 is to be replaced, the cut end portion of the web hanging from the web roll 18 is disposed within the vicinity of the splicer 22 and may possibly therefore interfere with or to damage the new web being fed or alternatively, cause damage to or a malfunction within the splicer 22, which is, of course, operationally undesirable.

Therefore, prior to the web roll replacement, a troublesome operation of rewinding the hanging web onto the body of the used web roll is required by means of an operator, making the automation of the roll replacement difficult or time-consuming. This rewinding operation is also some-what dangerous, since the operator must step into the mill roll stand. Moreover, it can be pointed out that if the web roll has a sufficiently large diameter and hence has a considerable amount of weight, the operator is endangered still further because he is liable to encounter the roll which has great inertia generated as a result of the rewinding operation of the used web roll.

Not only in the mill roll stand of the turret system type but also in those of the swing arm system type and of the chain drive system similar problems likewise exist.

Under such circumstances, the present applicant has proposed an invention entitled "WEB FEEDING DEVICE" and has accordingly filed a patent application on Apr. 15, 1988. The "web feeding device" according to this prior invention can be evaluated highly in that the center blocks are rotated in the direction which is opposite to that of the web delivering direction by a suitable drive means, whereby the web hanging from the web roll after completion of the splicing and cutting procedures can automatically be rewound onto the body of the web roll. However, the web may again be inadvertently delivered out from the web roll during the processes of loading, unloading and replacement of the webs, since the rewound cut end portion of the web is not fixed to the body of the web roll.

Therefore, an operator must in fact apply adhesive tape to the cut end portion of the web so as to fix it onto the body of the web roll after rewinding the web and moving the web roll to a web replacing position. Consequently, it is seen that if a device according to the prior invention is used, it still requires manual operations to be performed in connection with the replacement of the rolls, and thus full automation of the roll replacing procedures has been difficult to attain.

OBJECT OF THE INVENTION

This invention has been proposed in view of the above problems inherent in the process of web roll replacement and to overcome them accordingly, and is directed to providing a means which can eliminate heretofore required manual operations and which can achieve a reduction of operation time by automatically taping the cut end portion of the used web onto the body of the used web roll so as to achieve full automation of the roll replacing procedures.

SUMMARY OF THE INVENTION

For the purpose of overcoming the above problems and achieving the intended object, the present invention provides taping equipment, for use in conjunction with a web feeding device wherein the feeding of a web from a web roll is achieved by means of the free rotation of center blocks disposed upon a pair of movable members so as to oppose each other in such a way that they may be movable closer together or farther apart relative to each other, and the web is rewound by rotationally driving the center blocks in the direction opposite to the web delivering direction, comprising:

a lifter disposed adjacent to the web feeding device;

a roller rotatably supported at one end of a first arm pivotally supported upon a support disposed upon the upper surface of the lifter by means of a shaft, upon which adhesive tape delivered from a tape roll removably attached to the shaft is taken up with the adhesive surface thereof facing outwardly in the radial direction of the roller;

a first actuator connected to the other end of the first arm so as to turn the first arm around the shaft in the positive or negative direction so as to bring it to a position at which the roller is abutted against the circumference of the web roll or to a position at which the roller is spaced from the web roll;

a cutter disposed at the tip of a second arm which is pivotally supported by the shaft at one end thereof so as to be directed toward the tip end of the first arm;

a second actuator connected to the second arm which turns the second arm around the shaft in the positive or negative direction so as to bring it to a tape cutting position or to a stand-by position;

and a braking means disposed relative to the first arm which exerts a braking force with respect to the delivery of the tape when the tape is to be cut.

As has been described above, according to the taping equipment for a web feeding device constructed in accordance with this invention, adhesive tape can automatically be applied along the circumference of the web roll so as to prevent the free end of the web from separating from the web roll, whereby full automation of the web roll replacing procedures can be attained. Thus, the taping equipment according to this invention provides useful effects since the roll replacing operation can be achieved more rapidly so as to achieve a reduction in the cycle time and also to save eliminate manual operations.

BRIEF DESCRIPTION OF THE DRAWINGS

Various other objects, features, and attendant advantages of the present invention will become more fully appreciated from the following detailed description, when considered in connection with the accompayning drawings, in which like reference characters designate like or corresponding parts throughout the several views, and wherein:

FIG. 4(*b*) is a side view of the taping equipment which is performing an operation of applying adhesive tape to a web roll.

FIG. 4(*c*) is a side view of the taping equipment which is cutting the tape after completion of the procedure of taping the web roll.

DETAILED DESCRIPTION OF THE INVENTION

Figure 1:
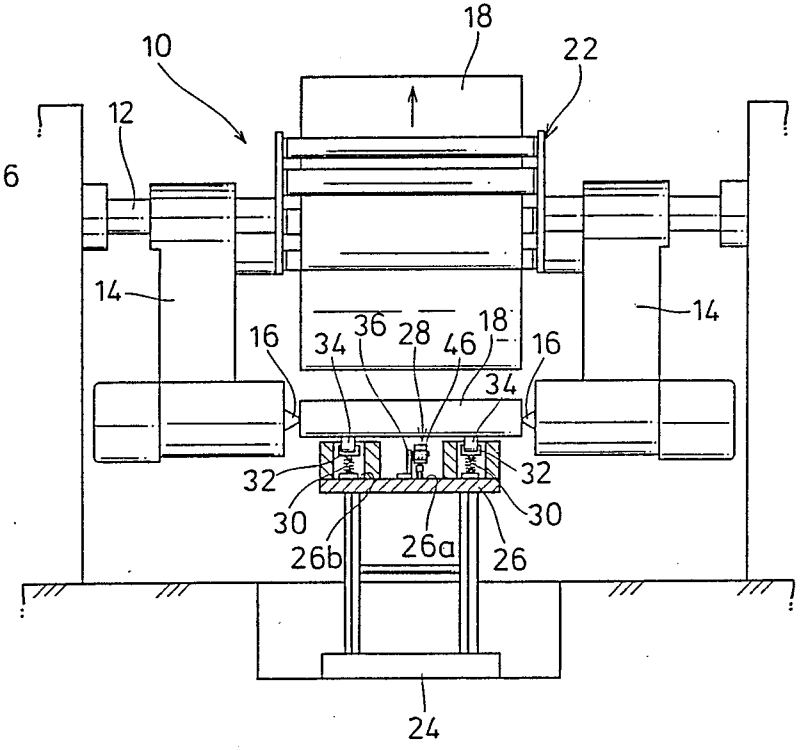
FIG. 1 is a front view of a mill roll stand in which the taping equipment according to a preferred embodiment of the present invention is employed.
Figure 2:
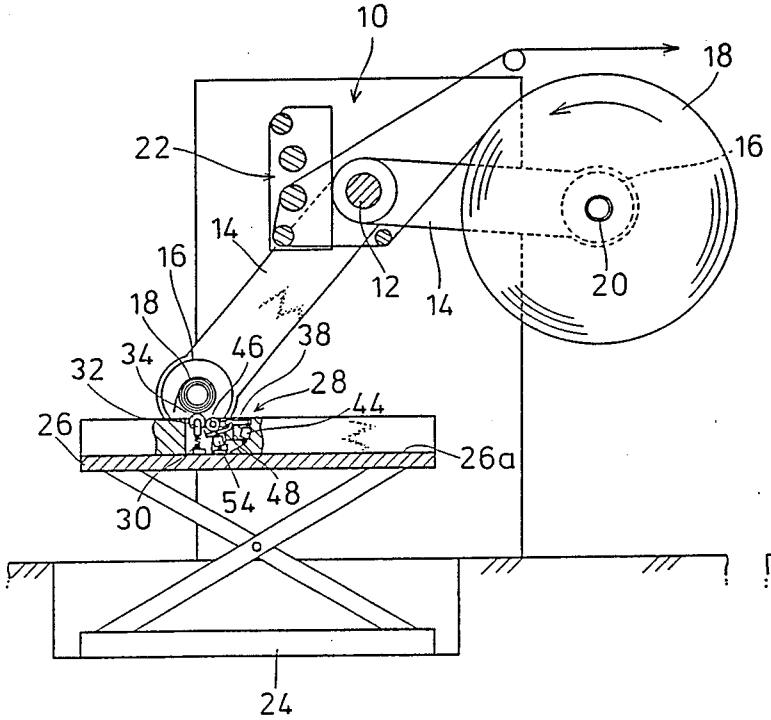
FIG. 2 is a partially cutaway cross-sectional view of the mill roll stand illustrated in FIG. 1.
Figure 6:
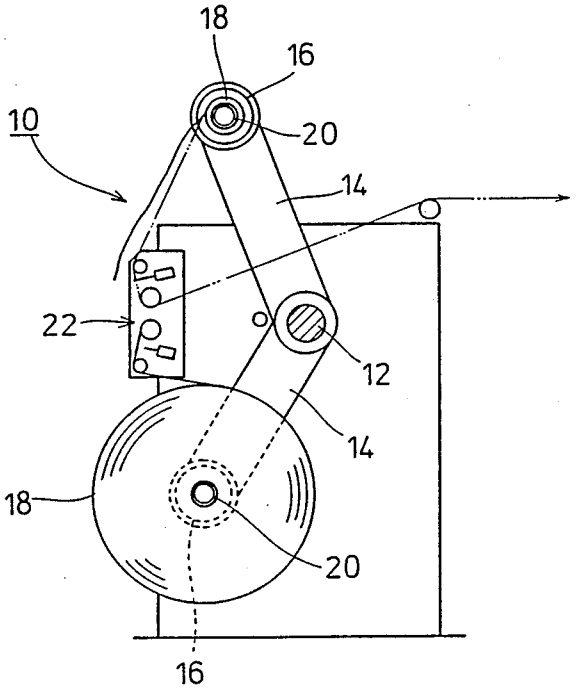
FIG.6 PRIOR ART
FIG. 6 is a cross-sectional view of the mill roll stand shown in FIG. 5, illustrating a state wherein the splicing of web rolls from the used one loaded upon the upper pair of arms to the new one loaded upon the lower pair of arms has been completed.
Figure 5:
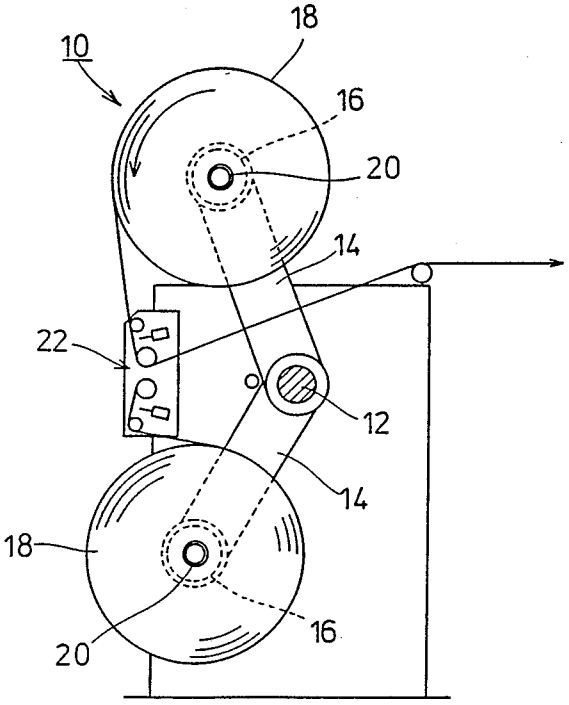
FIG.5 PRIOR ART
FIG. 5 is an illustration, in cross-section, of a prior art mill roll stand.
Figure 7:
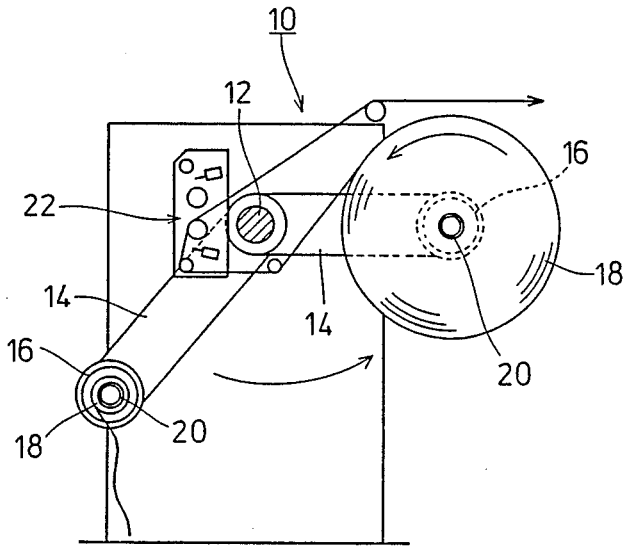
FIG.7 PRIOR ART
FIG. 7 is a cross-sectional view of the conventional mill roll stand, shown in FIG. 6 illustrating a state wherein the upper pair of arms are brought to the roll replacing position by turning the pivotal shaft from the angular position shown in FIG. 6.

The taping equipment for a web feeding device constructed according to the present invention will now be described below by means of a preferred embodiment and with reference being made to the attached drawings. Incidentally, since the mill roll stand itself has substantially the same construction as those of the prior art shown in FIGS. 5 to 7, a detailed description thereof will be omitted. FIG. 1 is a front view of a turret system type mill roll stand in which the equipment of this invention is employed; and FIG. 2 is a partially cutaway cross-sectional view of the equipment shown in FIG. 1. As illustrated, a pantographic lifter 24 which ascends or descends for unloading or loading a web roll 18 therefrom or during a thereon web roll operation is disposed at a position adjacent to the mill roll stand 10 and below the swing loci of the arms 14 of the mill roll stand 10. As shown in FIG. 2, this lifter 24 has a table 26 supported upon a pantographic mechanism for ascending or descending operations where-by such maintains its horizontal posture, the basic structure of the lifter 24 being well known. This lifter 24 is intended to achieve alignment of the paper tube 20 of the web roll 18 loaded upon the table 26 with the centers of center blocks 16 so as to effect automatic mounting of the web roll 18.

Each arm 14 has a motor (not shown) for rotationally driving the center block 16 disposed at the tip end portion of the arm 14. More particularly, and to describe the various operations more in detail, the center blocks 16 are designed to be rotated in the required direction upon completion of the splicing operation between a used web and a new web within a splicer 22 in accordance with an order change and the like, such that the portion of the used web hanging from the used web roll 18 after the cutting operation within the splicer 22 may be rewound onto the body of the used web roll 18.

Figure 3:
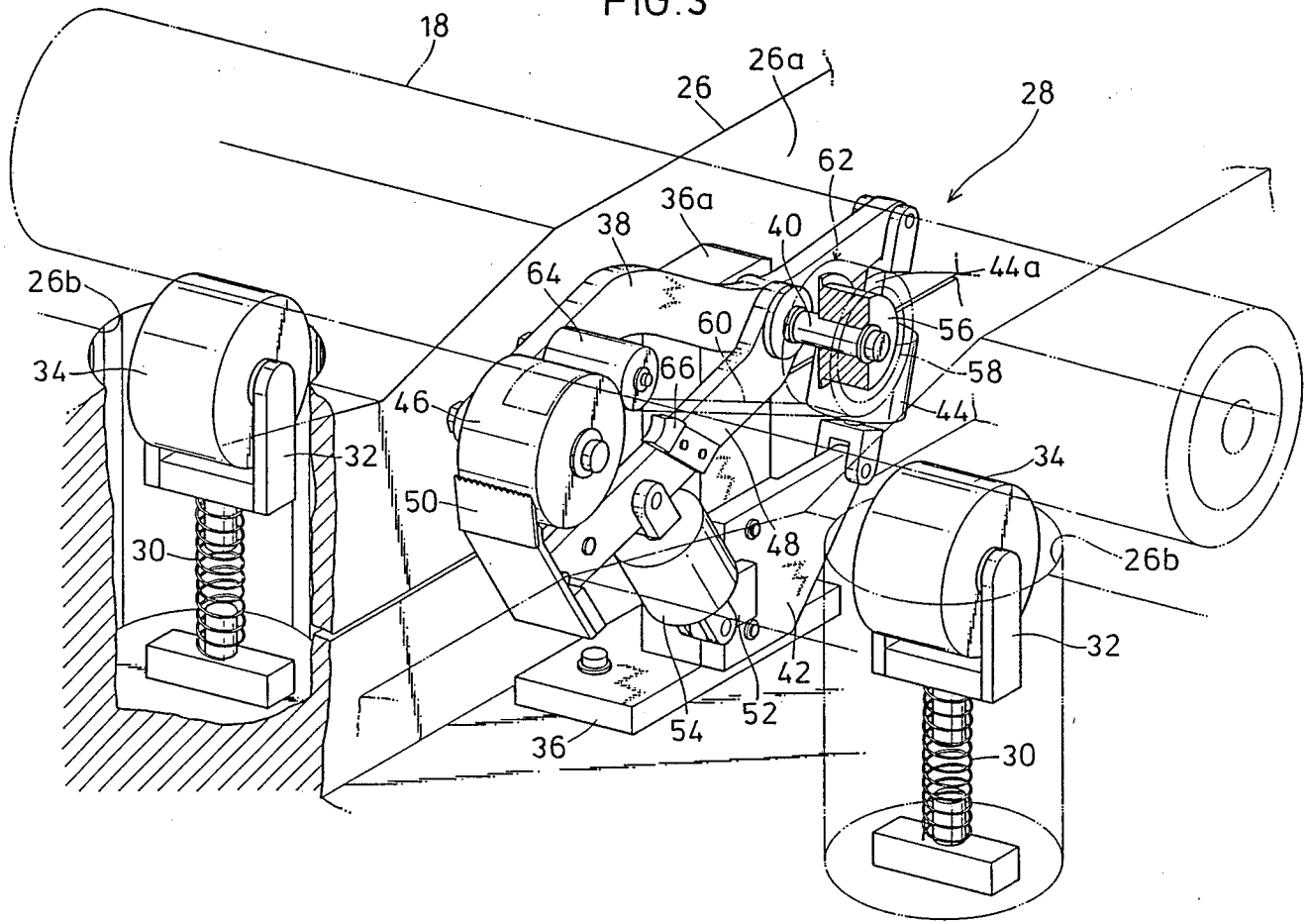
FIG. 3 is a schematic illustration of the taping equipment, in perspective view, according to the preferred embodiment of the present invention.
Figure 4:
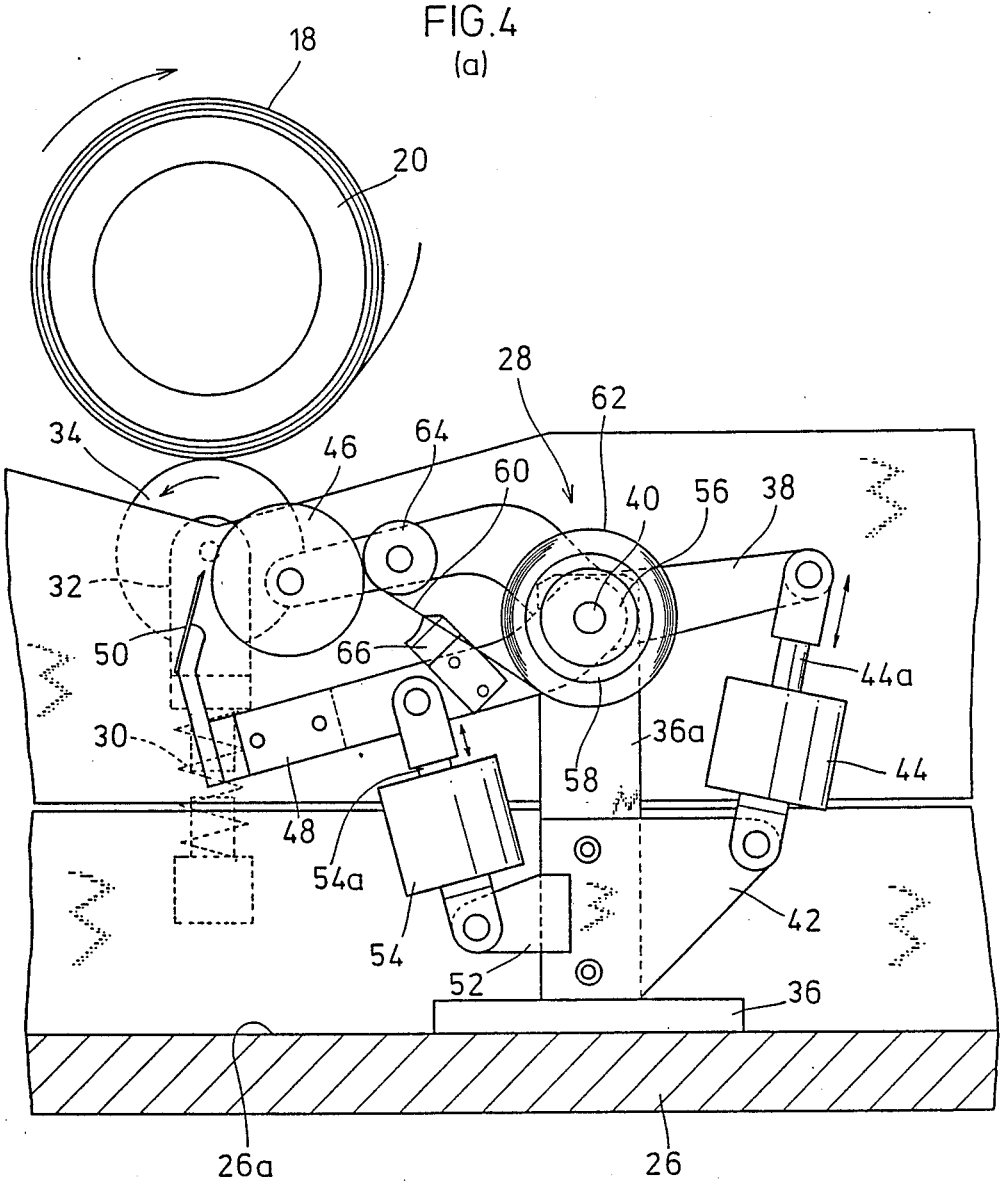
FIG. 4(*a*) is a side view of the taping equipment which is disposed in a stand-by posture.
Figure 4:
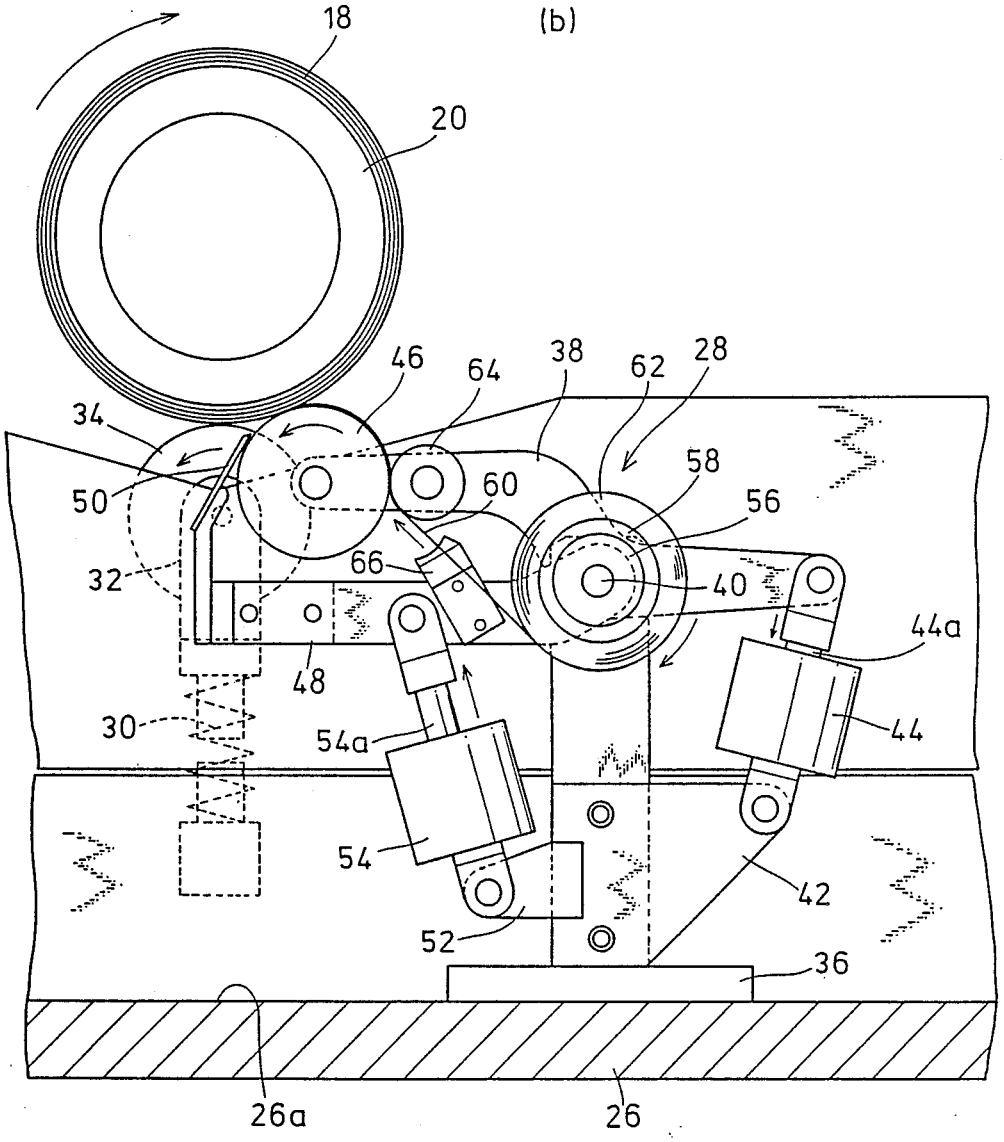
Figure 4:
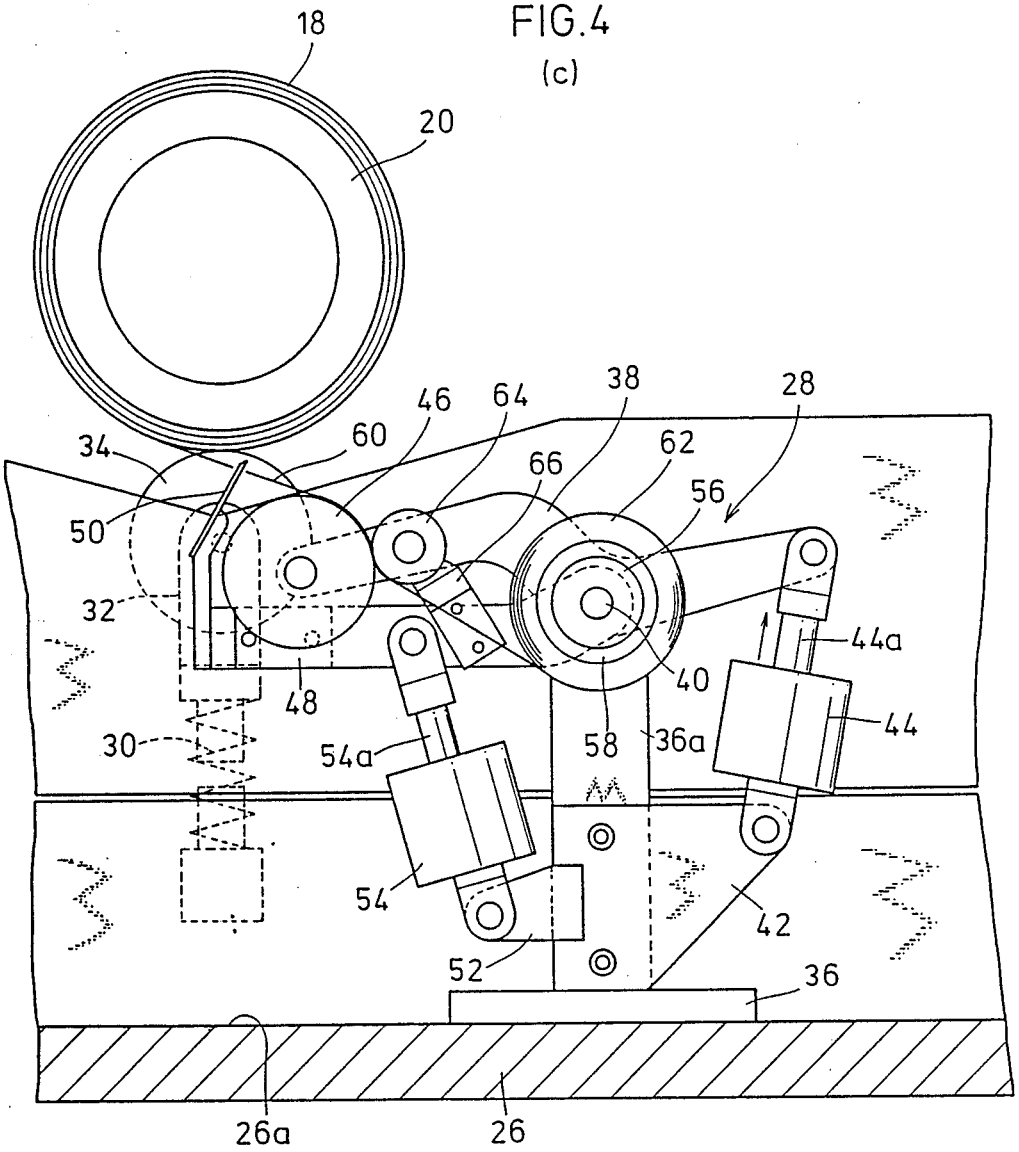

As shown in FIG. 1, a groove **26*a* is defined upon the table 26 of the lifter along the center line thereof, and taping equipment 28 (to be described later) is disposed within this groove 26*a*. On this table 26, a hole 26*b* having an upwardly extending opening is defined upon each side of the taping equipment 28 (see FIG. 3). Within the lower region of this hole 26*b*, a compression spring 30 is disposed so as to extend upwardly and thereby support a roller retainer 32 upon the upper end thereof. As shown in FIGS. 3 and 4, a supporting roller 34 is rotatably supported by means of this roller retainer 32, with a portion of the peripheral surface of the roller 34 protruding above the hole 26*b*, so that the peripheral surface of the roller may be disposed in contact with the circumferential or peripheral surface of the web roll 18 so as to rotate in the opposite direction to that of the rotation of the web roll 18**.

Each supporting roller 34 is designed to be positioned such that it may be disposed in contact with the circumferential surface of the web roll 18 when the arms 14 of the mill roll stand 10 are moved to the web roll replacing position and the lifter 24 is elevated toward the web roll 18 loaded upon the arms 14, as shown in FIG. 2.

As shown in FIG. 4, a support 36 is also fixed upon the bottom of the groove **26*a* and a first arm 38 having the illustrated shape is pivotally supported upon the upper part of a vertical member 36*a* of this support 36 by means of a shaft 40. A roller 46 is rotatably supported upon one end of this first arm 38, extending leftwardly relative to the support 36 that is, (the end adjacent to the positions where the supporting rollers 34 are disposed), so that it may rotate, as a result of being pressed against the web roll 18, in the direction opposite to that of the rotation of the web roll 18. Upon the circumferential surface of this roller 46, a single coated adhesive tape 60 delivered from a tape roll 62 (to be described later) is taken up such that the adhesive surface of tape 60 faces upwardly. A small diameter roller 64 is rotatably supported upon the first arm 38 at a position adjacent to the location of the roller 46 such that they may be abutted against each other with the tape 60 interposed therebetween. This roller 64 functions to control delivery of the tape 60 in cooperation with a stopper 66** (to be described later).

Since this small diameter roller 64 is disposed in contact with the adhesive surface of the tape 60, it is formed of a material to which the tape 60 does not readily adhere, such as, for example, a silicone rubber.

On the other end of the first arm 38, that is, the end opposite to the one where the roller 46 is disposed a, the piston rod **44*a* of a first air cylinder 44 connected to a bracket 42 disposed upon the support 36 by means of a pin is also connected by means of a pin. Consequently, by actuating the first air cylinder 44 in the positive or negative direction, the first arm 38 is pivoted in the required direction around the shaft 40, whereby the roller 46** can be shifted to the taping position (FIG. 4(*b*)) where the roller 46 protrudes above the upper surface of the table 26 or to the stand-by position (FIG. 4(*a*)) where the roller 46 is retracted within the groove **26*a***.

As shown in FIG. 3, the shaft 40 also rotatably supports a cylindrical holder 56 and a second arm 48 (to be described later), and the tape roll 62 comprising the single coated adhesive tape 60 wound upon a paper core 58 can be removably loaded upon this holder 56. The tape 60 delivered from the tape roll 62 loaded upon the holder 56 is taken up along the circumferential surface of the roller 46 with a predetermined length as described above, wherein the tape 60 is held between the roller 46 and the small diameter roller 64 in such a way that the tape 60 may not easily slip off the circumferential surface of the roller 46.

Upon the support 36, the second arm 48 is pivotally supported at one end thereof coaxially with the first arm 38, and at the tip of this second arm 48 extending toward the end of the first arm 38 upon which the roller 46 is disposed, a tape cutter 50 is disposed. In the middle of the second arm 48, a piston rod **54*a* of a second air cylinder 54 connected to a bracket 52 mounted upon the support 36 by means of a pin is also connected by means of a pin. Accordingly, by actuating the second air cylinder 54 in the positive or negative direction, the second arm 48 pivots in the required direction around the shaft 40, whereby the cutter 50 can be shifted to the tape cutting position (FIG. 4**(*b*)) where the cutter 50 protrudes above the upper surface of the table 26 or to the stand-by position (FIG. 4(*a*)) where the cutter 50 is retracted within the groove 26*a*.

Cutting of the tape 60 can be effected by shifting the roller 46 upon the first arm 38 to the stand-by position so as to bring the tape 60 disposed upon the circumferential surface of the web roll 18 into press contact with the cutter 50 which is waiting at the tape cutting position (see FIG. 4(*c*)) as will be described below.

The stopper 66 is disposed at a strategic position upon the second arm 48. This stopper 66, as shown in FIG. 4(*c*), is designed to exert a braking force upon the tape 60 by engaging the small diameter roller 64 during the tape cutting process, whereby the tape 60 is held tightly between the small diameter roller 64 and the roller 46. Namely, the stopper 66 functions to maintain the tape 60 applied to the web roll 18 in tension and also to prevent the tape 60 from being undesirably delivered from the tape roll 62 in response to the adhesive tape unwinding forces generated when the cutter 50 contacts the tape 60.

FUNCTION OF THE PREFERRED EMBODIMENT

Next, the function of the taping equipment having the aforenoted construction will be described. When a web roll 18 which has been delivering a web to a web consuming mechanism (not shown) and which is loaded upon the upper pair of arms 14 is to be replaced, the used web delivered from the web roll 18 is spliced with a new web of a new web roll loaded upon the lower pair of arms 14, within the splicer 22.

Prior to turning the pivotal shaft 12 for the purpose of achieving replacement of the used web roll 18 with a new web roll, the motor is driven so as to rotate the web roll 18 mounted between the center blocks 16 in the required direction, whereby the endportion of the web hanging from the used web roll 18 is rewound onto the body of the web roll 18.

Thereafter, as shown in FIG. 2, the pivotal shaft 12 is rotated so as to move the arms 14 to the replacement positions for the web rolls 18. When the arms 14 reach predetermined positions, a sensor (not shown) detects such disposition and elevates the lifter 24 as shown in FIG. 4(*a*) until the supporting rollers 34 protruding above the table 26 of the lifter 24 are abutted against the web roll 18, whereupon the movement is terminated. Incidentally, for example, a sensor mounted upon the lifter 24 detects the diameter of the web roll 18 so as to control the level to which the lifter 24 is elevated based upon the detection signal.

Next, when the used web roll 18 is rotatably supported upon the supporting rollers 34, the first air cylinder 44 is actuated such that the piston rod 44*a* thereof may be retracted, as shown in FIG. 4(*b*), so as to pivot the first arm 38 clockwise, whereby the roller 46 rotatably supported upon the arm 38 is pressed against the circumferential surface of the web roll 18. Upon the circumferential surface of the roller 46, the tape 60 preliminarily delivered from the tape roll 62 is conveyed with the adhesive surface thereof facing outwardly. Upon actuation of the first air cylinder 44, the second air cylinder 54 is simultaneously actuated such that the piston rod 54*a* thereof may protrude therefrom, whereby the second arm 48 is rotated clockwise so as to allow the cutter 50 to wait at the tape cutting position (see FIG. 4(*c*)).

Since the center blocks 16 are also rotationally driven in this state, the tape 60 conveyed by means of the roller 46 is delivered from the tape roll 62 so as to be applied along the circumferential surface of the web roll 18. Thus, the cut end portion of the web is adhesively secured onto the body of the web roll 18 so as to prevent inadvertent delivery of the web from the web roll during the operation of replacing or transporting of the web rolls. Incidentally, an improved effect can be obtained by disposing a plurality of taping stations 28 upon the table 26 along the axis of the web roll 18 to apply the tape 60 around the web roll 18 at several axially spaced, positions thereof.

When the sensor detects that the tape 60 delivered from the tape roll 62 has been applied onto the circumferential surface of the web roll 18 for one revolution or more, the motor is stopped so as to stop the rotation of the web roll 18. Next, as shown in FIG. 4(*c*), the first air cylinder 44 is actuated in such a way that the piston rod 44*a* thereof may protrude therefrom so as to rotate the first arm 38 counterclockwise. In this process, the cutter 50 and the stopper 66 are waiting at the respective tape cutting positions, as described above, the small diameter roller 64 disposed upon the first arm 38 is abutted against the stopper 66 so as to exert a braking force upon the tape 60, and also the cutter 50 is abutted against the tape 60 so as to effect cutting of the tape.

More particularly, the tape 60 applied along the circumferential surface of the web roll 18 is held between the roller 46 and the small diameter roller 64 under tensioned conditions. Accordingly, if the tape 60 in such state of tension is contacted by means of the cutter 50, the tape 60 can be cut without being delivered from the tape roll 62. After a predetermined period of time, the second air cylinder 54 is actuated in such a way that the second arm 48 may be turned counterclockwise so as to reset the cutter 50 to the stand-by position. Incidentally, the tape 60 cut by means of the cutter 50 is retained upon the circumferential surface of the roller 64 and waits for the successive taping operation to be performed.

After completion of the taping operation, the arms 14 of the mill roll stand 10 are spaced from each other so as to unload the web roll 18, whereby the web roll 18 is transferred onto the table 26 of the lifter 24. Thereafter, the lifter 24 descends, followed by replacement with another web roll 18.

Incidentally, in this preferred embodiment, description has been made of the case where the taping equipment of this invention is employed within a turret system type mill roll stand which comprises auxiliary equipment for a rotary press. However, this invention may not be limited thereto and can widely be utilized in the field of corrugators for manufacturing corrugated board sheets, coating machines, and the like.

Obviously, many modifications and variations of the present invention are possible in light of the above teachings. It is therefore to be understood that within the scope of the appended claims, the present invention may be practiced otherwise than as specifically described herein.

What is claimed is:

1. Taping apparatus for use in connection with a web feeding device wherein feeding of a web from a web roll is achieved by means of the free rotation of a pair of oppositely disposed, axially movable center block members which are movable relative to each other so as to adjust the axial distance defined therebetween in order to accommodate a predeterminedly sized web roll, and wherein further said web is rewound upon said web roll by rotationally driving said center block members in a direction opposite to the web feeding direction, comprising:

a lifter disposed adjacent to said web feeding device and being vertically movable so as to support a web roll when said web roll is being mounted upon or removed from said center block members;

a roller rotatably supported, at one end of a first arm which is pivotally supported upon a support disposed upon the upper surface of said lifter, by means of a shaft, and upon which an adhesive tape, delivered from a tape roll which is removably attached to said shaft, is conducted with the adhesive surface thereof facing outwardly in the radial direction of said roller;

a first actuator connected to a second end of said first arm for rotating said first arm around said shaft in clockwise and counterclockwise directions so as to bring said roller to a position at which said roller is abutted against the circumference of said web roll whereby said adhesive tape can be applied to said web roll or to a position at which said roller is spaced from said web roll;

a cutter disposed at a tip end of a second arm which is pivotally supported by said shaft at one end thereof;

a second actuator connected to said second arm for rotating said second arm around said shaft in clockwise and counterclockwise directions so as to bring said cutter to a tape cutting position or to a standby position; and braking means interposed between said tape roll and said roller for exerting a braking force upon said adhesive tape when said adhesive tape is to be cut.

2. The taping apparatus for a web feeding device according to claim 1, wherein said braking means comprises:

a small diameter roller which is rotatably supported upon said first arm so as to be disposed adjacent to said roller whereby said small diameter roller rotates, as a result of being abutted against said roller through means of said adhesive tape conducted over said roller, in the direction opposite to that of said roller; and a stopper disposed upon said second arm for exerting said braking force to said adhesive tape by contacting said small diameter roller during said tape cutting operation.

3. Taping apparatus as set forth in claim 1, wherein: said first and second actuators comprise pneumatic piston-cylinder assemblies.

4. Taping apparatus for use in connection with a web feeding device wherein feeding of a web from a web roll in a feeding direction is achieved by means of the free rotation of a pair of oppositely disposed, axially movable center blocks which are movable toward and away from each other so as to adjust the axial distance defined therebetween in order to properly accommodate a predeterminedly sized web roll, and wherein further, said web is rewound upon said web roll by rotatably driving said center blocks in a direction opposite to said web feeding direction, comprising:

a lifter disposed adjacent to said web feeding device and being vertically movable relative to said center blocks so as to support a web roll when said web roll is being mounted upon or removed from said center blocks;

adhesive tape roll means, for supplying adhesive tape toward said web roll in order to secure a free residual end of said web upon said web roll, mounted upon said lifter;

a roller rotatably mounted upon said lifter for conducting said adhesive tape into contact with said free residual end of said web upon said web roll in such a manner that the adhesive surface of said adhesive tape is disposed toward said free residual end of said web upon said web roll;

a cutter mounted upon said lifter for cutting said adhesive to tape after completion of a taping operation with respect said free residual end of said web upon said web roll;

first actuating means mounted upon said lifter for moving said roller between a first taping position at which said roller is in circumferential contact with said web roll so as to apply said adhesive tape to said free residual end of said web upon said web roll, and a second position at which said adhesive tape secured to said web roll and extending between said web roll and said roller can be cut by said cutter; and second actuating means mounted upon said lifter for moving said cutter between a first position at which said cutter can cut said adhesive tape adhesively applied to said web roll and when said roller is disposed at said second position by said first actuating means, and a second position at which said cutter is retracted away from said web roll.

5. Taping apparatus as set forth in claim 3, further comprising:

braking means interposed between said adhesive tape roll means and said roller for exerting a braking force upon said adhesive tape when said adhesive tape is to be cut by said cutter.

6. Taping apparatus as set forth in claim 5, wherein said braking means comprises:

a small diameter roller disposed adjacent to said roller such that said small diameter roller rotates, as a result of being disposed in contact with said roller through means of said adhesive tape conducted over said roller, in a direction opposite to that of said roller; and a stopper disposed adjacent to said small diameter roller so as to contact said small diameter roller and thereby exert a braking force upon said adhesive tape during said tape cutting operation.

7. Taping apparatus as set forth in claim 4, wherein: said first and second actuating means comprise pneumatic piston-cylinder assemblies.

8. Taping apparatus for use in connection with a web feeding device wherein feeding of a web from a web roll in a feeding direction is achieved by means of the free rotation of a pair of oppositely disposed, axially movable center blocks which are movable toward and away from each other so as to adjust the axial distance defined therebetween in order to properly accommodate a predeterminedly sized web roll, and wherein further, said web is rewound upon said web roll by rotatably driving said center blocks in a direction opposite to said web feeding direction, comprising:

a lifter disposed adjacent to said web feeding device and being vertically movable relative to said center blocks so as to support a web roll when said web roll is being mounted upon or removed from said center blocks;

adhesive tape roll means, for supplying adhesive tape toward said web roll in order to secure a free residual end portion of said web upon said web roll, mounted upon said lifter;

roller means movably mounted upon said lifter between a first position at which said adhesive tape can be supplied with its adhesive surface disposed in contact with said free residual end portion of said web roll, and a second retracted position; and cutting means movably mounted upon said lifter between a first cutting position, corresponding to said second retracted position of said roller means, at which said cutting means cuts said adhesive tape extending between said web roll and said roller means, and a second position at which said cutting means is retracted away from said web roll.

9. Taping apparatus as set forth in claim 8, wherein:

said roller means and said cutting means comprises pneumatic piston-cylinder assemblies for moving said roller means and said cutting means between said respective first and second positions.

10. Taping apparatus as set forth in claim 8, further comprising:

braking means interposed between said adhesive tape roll means and said roller for exerting a braking force upon said adhesive tape when said adhesive tape is to be cut by said cutting means.

11. Taping apparatus as set forth in claim 10, wherein said braking means comprises:

a small diameter roller disposed adjacent to said roller means such that said small diameter roller rotates, as a result of being disposed in surface contact with said roller means through means of said adhesive tape conducted over said roller means, in a direction opposite that of said roller means; and a stopper disposed adjacent to said small diameter roller so as to contact said small diameter roller and thereby exert said braking force upon said adhesive tape during said tape cutting operation.

* * * * *